US006380820B1

(12) United States Patent
Sakamoto et al.

(10) Patent No.: US 6,380,820 B1
(45) Date of Patent: Apr. 30, 2002

(54) ISOLATOR UTILIZING A PLANAR DIELECTRIC TRANSMISSION LINE WITH A RESISTIVE FILM

(75) Inventors: Koichi Sakamoto, Otsu; Hiromu Tokudera, Nagokakyo, both of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/478,749

(22) Filed: Jan. 6, 2000

(30) Foreign Application Priority Data

Jan. 6, 1999 (JP) ..... 11-000969

(51) Int. Cl.[7] ..... H01P 1/36
(52) U.S. Cl. ..... 333/24.2
(58) Field of Search ..... 333/1.1, 24.2

(56) References Cited

U.S. PATENT DOCUMENTS 4,027,253 A * 5/1977 Chiron et al. ..... 333/24.2 X
5,986,527 A * 11/1999 Ishikawa et al. ..... 333/239

FOREIGN PATENT DOCUMENTS

JP 63-124602 5/1988
JP 4287403 10/1992
SU 1592887 * 9/1990 ..... 333/24.2

* cited by examiner

*Primary Examiner*—Justin P. Bettendorf
(74) *Attorney, Agent, or Firm*—Ostrolenk, Faber, Gerb & Soffen, LLP

(57) ABSTRACT

A nonreciprocal circuit device includes conductive films that define a slot on the top of a magnetic member having ferrimagnetic characteristics. On the bottom of the magnetic member, other conductive films that define an opposing slot are formed. An external DC magnetic field is applied substantially parallel to the magnetic member and substantially perpendicular to the slots. Resistive films are formed alongside the slot on the top of the magnetic member. When a signal propagates in the direction from port #2 to port #1, the electromagnetic field of a planar dielectric line mode is localized in the direction of the resistive films. Electrical power is consumed by the resistive films, so that the signal is prevented from propagating. When the signal propagates in the direction from port #1 to port #2, no loss is caused by the resistive films. Therefore, the signal is transmitted with low loss.

10 Claims, 15 Drawing Sheets

FIG. 4A
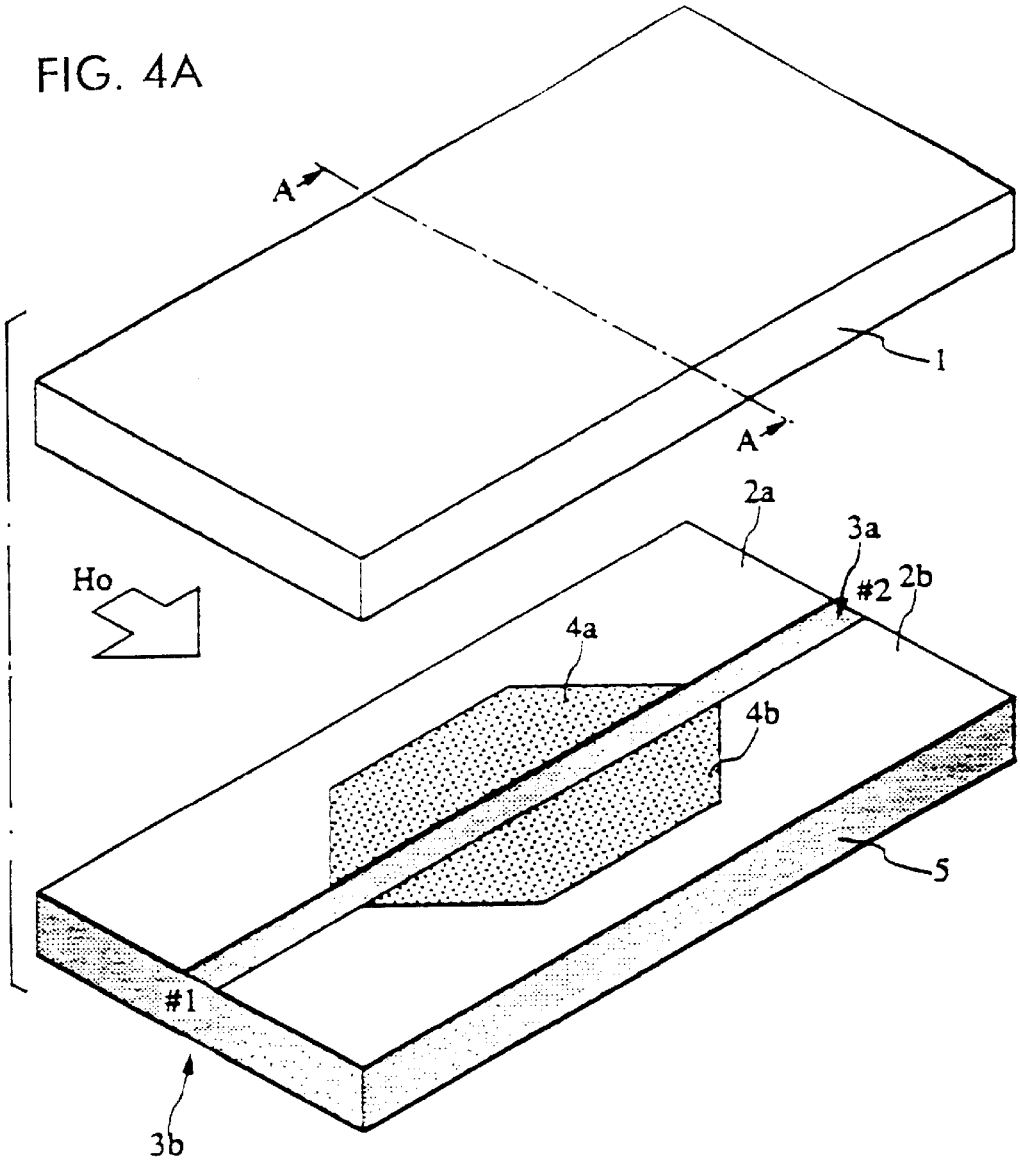
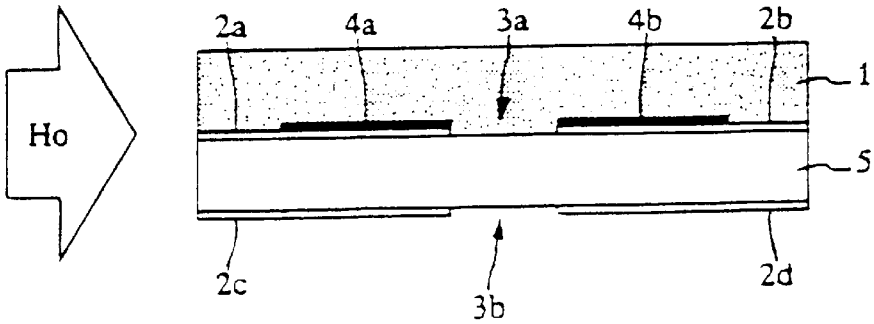
FIG. 4B

FIG. 5A
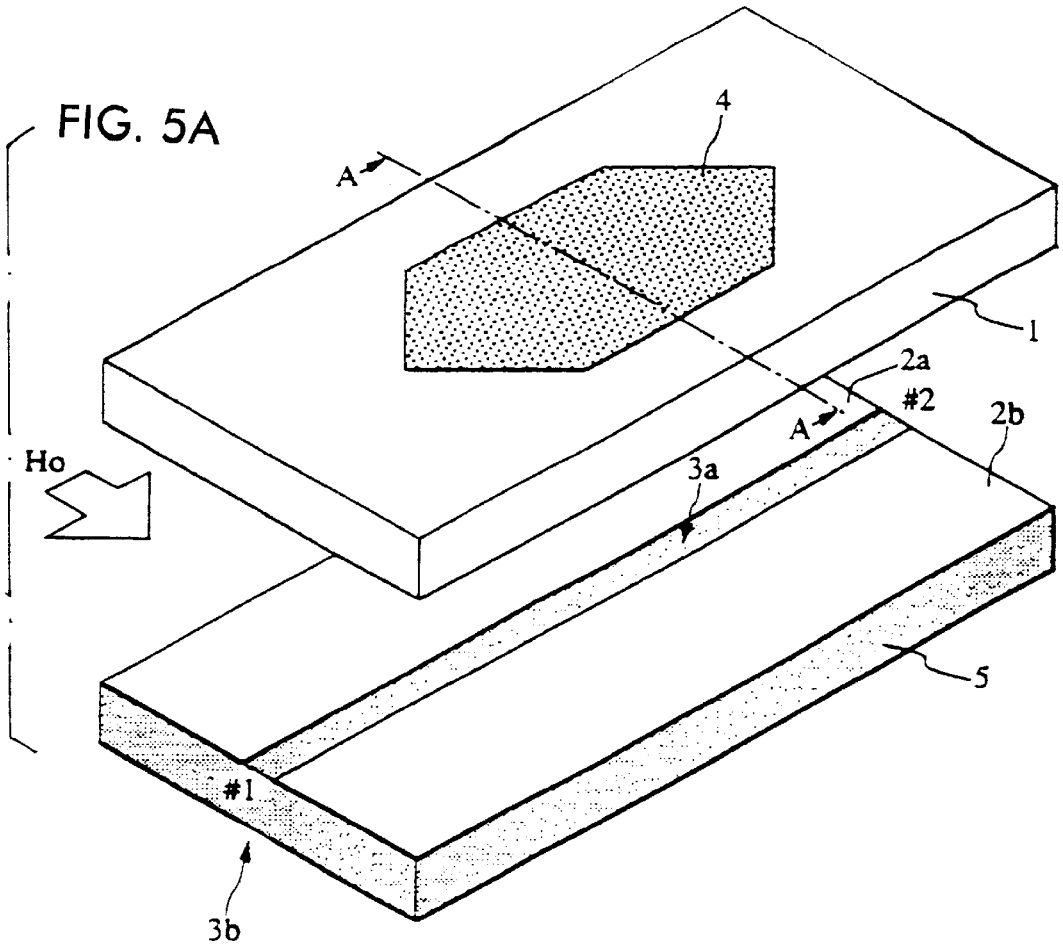
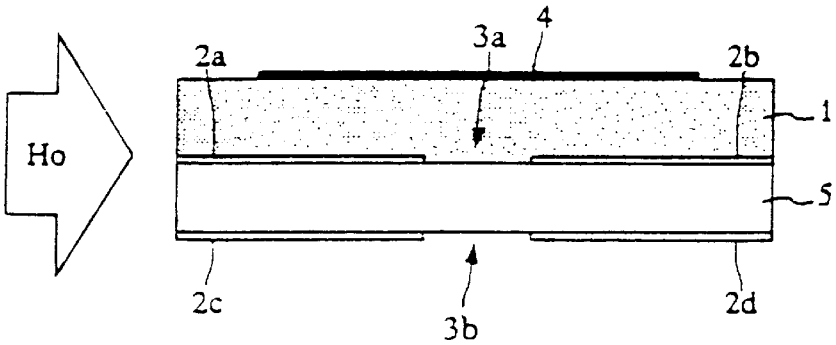
FIG. 5B
FIG. 5C
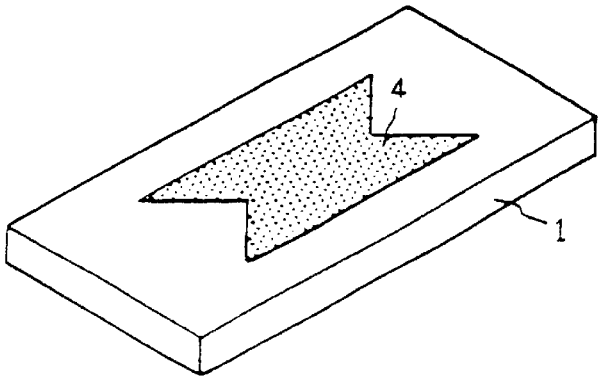

ISOLATOR UTILIZING A PLANAR DIELECTRIC TRANSMISSION LINE WITH A RESISTIVE FILM

BACKGROUND OF THE INVENTION

1. Field of the Invention

The present invention relates to a nonreciprocal circuit device and a nonreciprocal circuit apparatus, which may be used as an isolator in the microwave band and the millimeter-wave band, and to a transceiver using the same.

2. Description of the Related Art

Hitherto, conventional isolators using an edge-guided mode have been disclosed in Japanese Unexamined Patent Publication No. 4-287403 and Japanese Unexamined Patent Publication No. 63-124602, incorporated by reference.

The former isolator includes a microstrip line formed on a magnetic base member and a strip conductor grounded at the middle to one side, in which an external DC magnetic field is applied to the magnetic base member in the perpendicular direction. The latter isolator includes a coplanar waveguide (hereinafter referred to as a "coplanar line") formed on a magnetic base member and an electromagnetic wave absorber formed from a central conductor of the coplanar line to one ground conductor, in which an external DC magnetic field is applied to the magnetic base member in the perpendicular direction. Both the former and the latter isolators generate an isolation effect by varying magnetic characteristics in the magnetic base member by means of the external DC magnetic field, causing the electromagnetic field distribution of a propagation mode at both sides of the line to be asymmetrical due to an edge-guiding effect, and selectively attenuating a propagating signal in accordance with the direction of the external magnetic field and the propagating direction of the signal.

The former isolator employs the microstrip line as a transmission line. When the isolator is provided on a planar circuit formed by the microstrip line, connectability of the circuit is relatively easy. The latter isolator employs the coplanar line as a transmission line, so that a transition between the coplanar line and, for example, a coaxial line is relatively simple.

However, the microstrip line and the coplanar line have relatively large transmission losses. When the transmission distance is long, and particularly, when low transmission loss is required, the microstrip line and the coplanar line are not suitable.

An alternative transmission line includes a cavity waveguide or a nonradiative dielectric waveguide that has low transmission loss. However, when these waveguides are used for forming a nonreciprocal circuit device such as an isolator, the overall size of the isolator must be large. On the other hand, when the nonreciprocal circuit device formed by the microstrip line or the coplanar line is used, a line transition element is required for transition between the microstrip line or the coplanar line and the cavity waveguide or the nonradiative dielectric waveguide. As a result, the overall size is not reduced, and conversion loss occurs.

SUMMARY OF THE INVENTION

The present invention is able to provide a nonreciprocal circuit device for eliminating or minimizing the above problems.

The present assignee has previously filed a patent application disclosing a planar dielectric transmission line in Japanese Unexamined Patent Publication 8-265007, published Oct. 11, 1996, corresponding to U.S. patent application Ser. No. 08/832,305 filed Apr. 3, 1997, now U.S. Pat. No. 5,986,527 issued Nov. 16, 1999, incorporated by reference. This planar dielectric transmission line includes opposing slots formed on both sides of a dielectric base member, and employs a region where the slots oppose each other with the dielectric base member therebetween as a propagation region. The planar dielectric line has very small transmission loss. The present invention employs this type of planar dielectric line to generate nonreciprocal circuit characteristics by means of the planar dielectric line alone.

According to one aspect of the present invention, there is provided a nonreciprocal circuit device including conductive films formed on both sides of a substrate which has ferrimagnetic characteristics, first and second slots formed respectively in the conductive films and opposing each other, and at least one resistive film formed on a corresponding one of the faces of the substrate near the corresponding slot. A DC magnetic field is applied to the substrate so as to be substantially parallel to the substrate and to be substantially perpendicular to the first and second slots, and the nonreciprocal circuit device is thereby obtained.

Alternatively, the substrate may be a dielectric member, and a magnetic member may be stacked in the dielectric member adjacent to the resistive film. Also, a second resistive film may be formed on the one face of the substrate on an opposite side of the corresponding slot from the first-mentioned resistive film.

According to another aspect of the present invention, there is provided a nonreciprocal circuit device including conductive films formed on both sides of a substrate which has ferrimagnetic characteristics, first and second slots formed respectively in the conductive films and opposing each other, and a resistive film formed on one side of the substrate near at least one of the first and second slots. A DC magnetic field is applied to the substrate so as to be substantially perpendicular to the substrate, and the nonreciprocal circuit device is thereby obtained.

Alternatively, the substrate may be a dielectric member, and a magnetic member may be stacked in the dielectric member adjacent to the resistive film. Also, a second resistive film may be formed on the other side of the substrate near the other of the first and second slots.

The above substrate having ferrimagnetic characteristics also serves as a dielectric member having a predetermined dielectric constant. The first and second slots operate as a planar dielectric transmission line in which the interior of the substrate sandwiched between the first and second slots serves as a propagation region. Specifically, the dielectric constant and the thickness of the substrate are determined so that electromagnetic waves propagate while being totally reflected from a first side of the substrate in the first slot and a second side of the substrate in the second slot. Accordingly, the first and second slots operate as a planar dielectric transmission line having very small transmission loss.

Preferably, the substrate is formed by stacking a magnetic member having ferrimagnetic characteristics and a dielectric member, and the conductive films are formed on the dielectric member. With this arrangement, connectability of the nonreciprocal circuit device with another planar circuit formed on the dielectric member is extremely easy. For example, when the nonreciprocal circuit device according to the present invention is provided on the dielectric member on which a planar circuit is formed, there is no need to employ a structure in which the planar circuit formed on the dielectric member and the nonreciprocal circuit device formed on the magnetic member are connected.

According to another aspect of the present invention, there is provided a nonreciprocal circuit device including conductive films formed on both sides of a dielectric member defining first and second slots which oppose each other, a magnetic member having ferrimagnetic characteristics being stacked on the dielectric member, and a resistive film, which opposes one of the areas of the first and second slots, formed on the magnetic member. A DC magnetic field is applied to the dielectric member and the magnetic member so as to be substantially parallel to the dielectric member and the magnetic member and to be substantially perpendicular to the first and second slots, and the nonreciprocal circuit device is thereby obtained.

As described above, even when the resistive film is separated from the conductive films, the electromagnetic field distribution of a propagation mode is localized (concentrated) toward the resistive film when a signal propagates in the blocking direction. Electrical power is consumed by the resistive film, and the signal is thereby attenuated. In this case, the resistive film is not required to form a slot, thus simplifying the patterning of the resistive film.

Preferably, an end of the resistive film along the direction of the slot is tapered. Impedance characteristics of the transmission line changes gradually, and signal reflection is thereby suppressed.

According to another aspect of the present invention, there is provided a nonreciprocal circuit apparatus including the above nonreciprocal circuit device, a yoke for forming a magnetic path by covering the periphery of the substrate, and a magnet for generating the DC magnetic field. With this arrangement, a nonreciprocal circuit apparatus is obtained which may be used as a miniaturized isolator having the substrate, the magnet, and the yoke integrated therein.

According to another aspect of the present invention, there is provided a transceiver including the above nonreciprocal circuit device or the nonreciprocal circuit apparatus.

Other features and advantages of the present invention will become apparent from the following description of embodiments of the invention which refers to the accompanying drawings.

BRIEF DESCRIPTION OF THE DRAWINGS

FIG. 4A is an exploded perspective view of a nonreciprocal circuit device according to a second embodiment of the present invention;

FIG. 4B is a cross sectional view of the nonreciprocal circuit device taken along the line A—A in FIG. 4A;

FIG. 5A is an exploded perspective view of a nonreciprocal circuit device according to a third embodiment of the present invention;

FIG. 5B is a cross sectional view of the nonreciprocal circuit device taken along the line A—A in FIG. 5A;

FIG. 5C is a perspective view of a magnetic member having a pattern differing from that shown in FIG. 5A.

DESCRIPTION OF THE PREFERRED EMBODIMENTS

Referring to FIGS. 1A and 1B, FIGS. 2A and 2B, and FIGS. 3A to 3C, a structure of a nonreciprocal circuit device according to a first embodiment of the present invention is described.

Figure 1A:
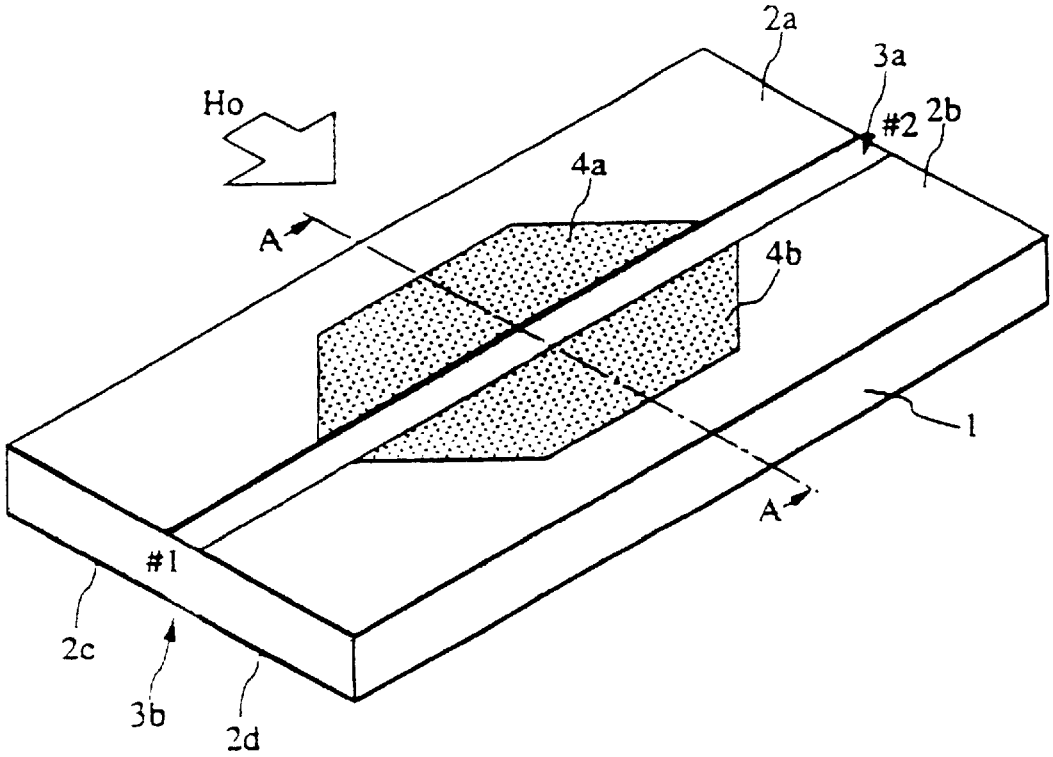
FIGS. 1A and 1B are perspective views of a nonreciprocal circuit device according to a first embodiment of the present invention.
Figure 1B:
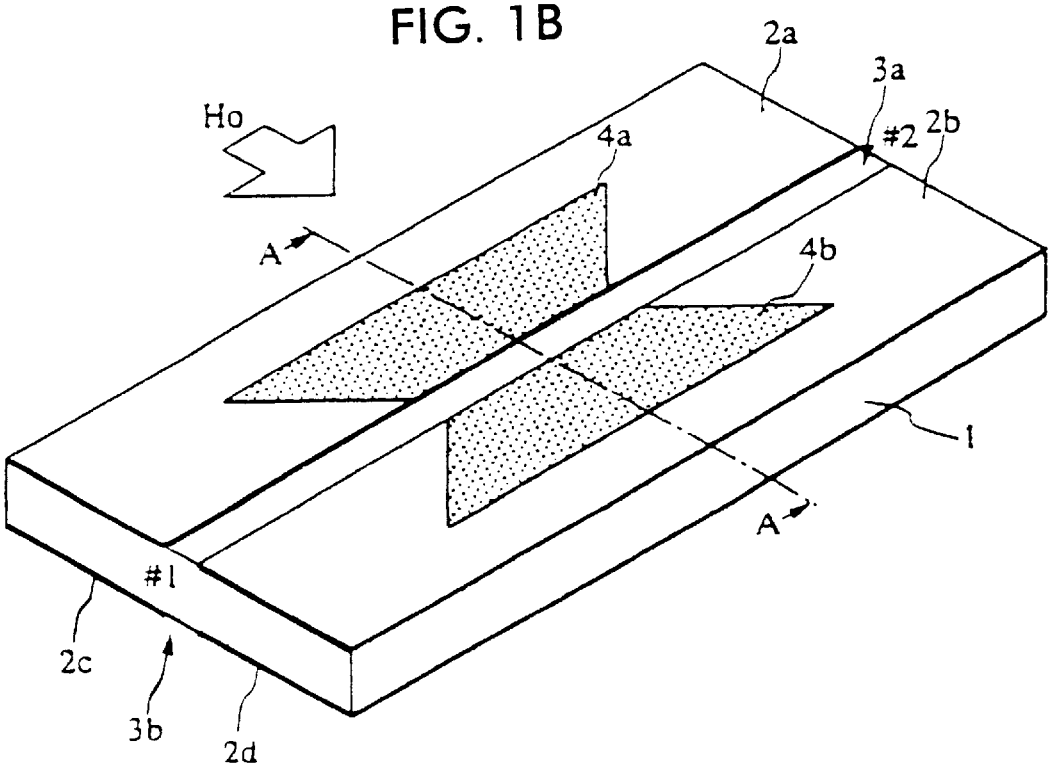

FIGS. 1A and 1B are perspective views of the nonreciprocal circuit device, showing two different examples. A magnetic member 1 having ferrimagnetic characteristics includes a ferrite or yttrium-iron-garnet (YIG). Conductive films 2*a* and 2*b* having a first slot 3*a* are formed on one surface (the top surface in FIGS. 1A and 1B) of the magnetic member 1. On another surface (the bottom surface), conductive films 2*c* and 2*d* having a second slot 3*b* are formed. On the top of the conductive films 2*a* and 2*b*, resistive films 4*a* and 4*b* are formed along the slot 3*a* at both sides of the slot 3*a*. In FIGS. 1A and 1B, the resistive films 4*a* and 4*b* are of different shapes. In FIG. 1A, the resistive films 4*a* and 4*b* are tapered in a direction away from the slot. In FIG. 1B, their end edges diverge in a direction away from the slot. As shown in FIGS. 1A and 1B, an external DC magnetic field Ho is applied parallel to the magnetic member 1 and perpendicular to the slots 3*a* and 3*b*.

The above conductive films 2*a* to 2*d* and the magnetic member 1 form a planar dielectric transmission line. In this embodiment, as shown in FIGS. 1A and 1B, the planar dielectric transmission line is employed as the nonreciprocal circuit device having two ports: port #1 in the left foreground, and port #2 in the right background.

Figure 2A:
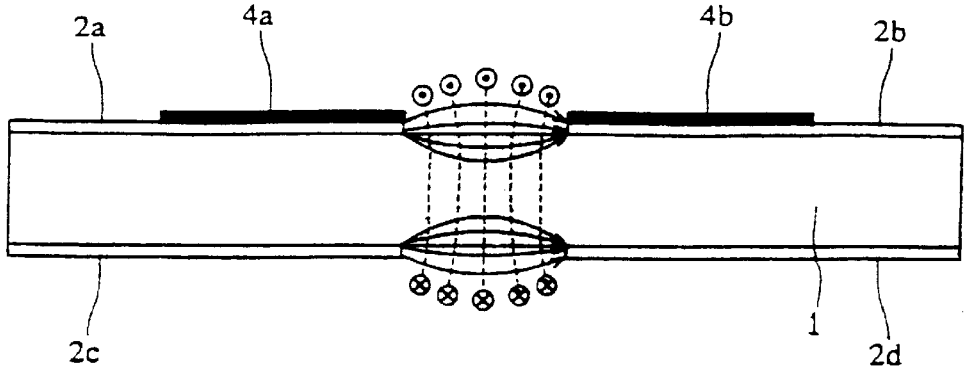
FIGS. 2A and 2B are cross sectional views taken along the lines A—A in FIGS. 1A and 1B to schematically illustrate the magnetic field distribution of the nonreciprocal circuit device shown in FIGS. 1A and 1B.
Figure 2B:
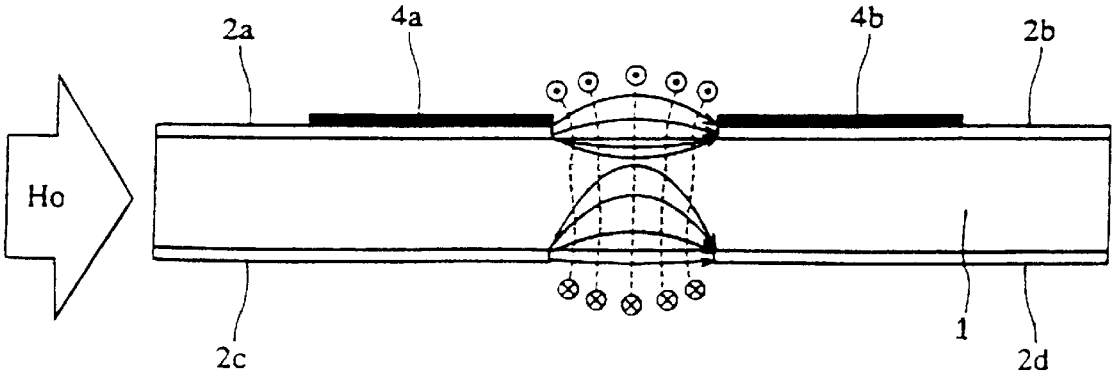

FIGS. 2A and 2B are cross sectional views taken along the lines A—A in FIGS. 1A and 1B to illustrate changes in the electromagnetic field distribution of a propagation mode (hereinafter referred to as a "PDTL mode"; this propagation mode is disclosed in JP8-265007) of the planar dielectric transmission line by means of the application of the external DC magnetic field. Although omitted in FIGS. 2A and 2B, conductive members for shielding are disposed in parallel to the magnetic member 1 at a predetermined distance above and below respective sides of the magnetic member 1.

In this embodiment, a signal propagates from the back to the front (from port #2 to port #1 in FIGS. 1A and 1B). Referring again to FIGS. 2A and 2B, solid lines represent electric field distributions, and broken lines represent magnetic field distributions. When the DC magnetic field Ho is not applied, the signal propagates in the normal PDTL mode, as shown in FIG. 2A. When the DC magnetic field Ho is applied, as shown in FIG. 2B, the electromagnetic field distribution of the PDTL mode is drawn upward in FIG. 2B, so that the energy of the electromagnetic field is concentrated in the first slot portion where the resistive films are formed. As a result, electrical power is consumed when current flows in the resistive films 4*a* and 4*b*. Thus, the signal in the PDTL mode is greatly attenuated. In contrast, when the signal propagates from the front to the back (from port #1 to port #2), the electromagnetic field distribution of the PDTL mode is drawn downward. Thus, the electromagnetic field energy distribution becomes sparse on the side of the resistive films 4*a* and 4*b*. As a result, power consumption by the resistive films 4*a* and 4*b* is suppressed, and the signal propagates without being significantly attenuated. With this operation, the device may be used as an isolator which selectively propagates signals from port #1 to port #2. When the DC magnetic field is applied in the reverse direction, the localizing direction of the electromagnetic field distribution of the propagation mode, which is determined in accordance with the direction of the DC magnetic field and the propagating direction of the signal, is reversed. Therefore, the isolation is reversed in direction.

As shown in FIG. 1A, the ends of the resistive films 4*a* and 4*b* along the slot are tapered. When the signal propagates in the blocking direction, the impedance characteristic of the transmission line changes gradually, and signal reflection is thereby suppressed. When the signal propagates in the transfer direction, there is no significant influence by the resistive films because the energy density of the electromagnetic field on the side of the resistive films is low. As shown in FIG. 1B, when the width of the resistive films gradually increases, the impedance characteristic of the transmission line changes gradually even when the signal propagates in the transfer direction. Therefore, significant signal reflection is not caused by the resistive films.

Figure 3A:
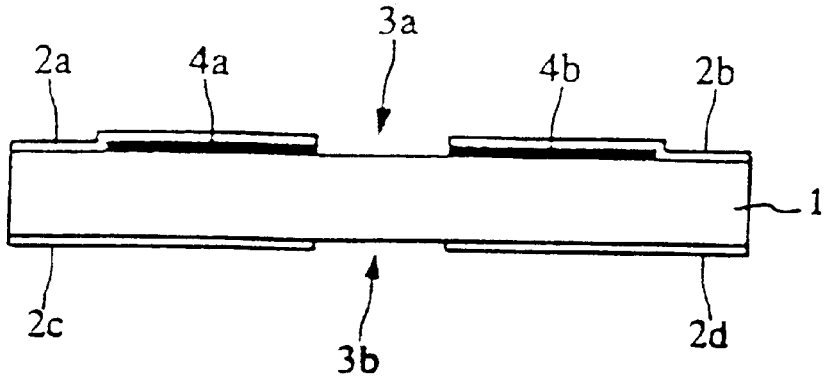
FIGS. 3A to 3C are cross sectional views of other examples of the nonreciprocal circuit device shown in FIGS. 1A and 1B.
Figure 3B:
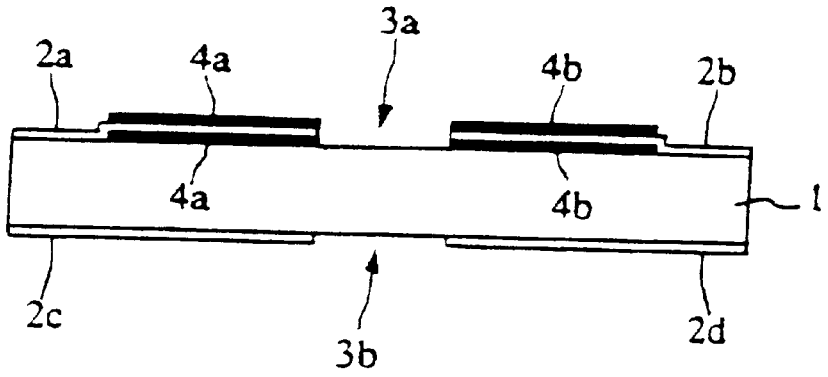
Figure 3C:
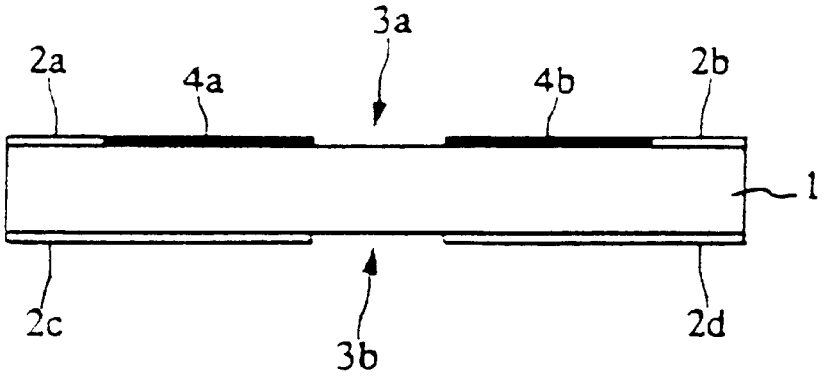

FIGS. 3A to 3C are cross sectional views of other modified embodiments of the nonreciprocal circuit device shown in FIGS. 1A and 1B. These cross sectional views are orthogonal to the slots. The resistive films of these embodiments have the same plane patterns as those shown in FIGS. 1A and 1B. In the embodiment shown in FIG. 3A, the resistive films 4*a* and 4*b* are formed on the surface of the magnetic member 1, and the conductive films 2*a* and 2*b* are formed on the resistive films. In the embodiment shown in FIG. 3B, the resistive films 4*a* and 4*b*, the conductive films 2*a* and 2*b*, and additional resistive films 4*a* and 4*b* are stacked respectively in that order. As in FIGS. 3A and 3B, even when the conductive films and the resistive films are stacked together, current distribution is concentrated in the resistive films due to the skin effect. Thus, electrical power is efficiently consumed. In the embodiment in FIG. 3C, the resistive films 4*a* and 4*b* are formed in the same plane as the conductive films 2*a* and 2*b*.

These embodiments have the resistive films formed on both sides of the slot. Alternatively, only one of the resistive films 4*a* and 4*b* may be formed. In such a case, electrical power is consumed in the resistive film portion when the signal propagates in the blocking direction. Therefore, signal propagation is blocked.

Referring now to FIGS. 4A and 4B, a structure of a nonreciprocal circuit device according to a second embodiment of the present invention is described. FIG. 4A is an exploded perspective view of the nonreciprocal circuit device. FIG. 4B is a sectional view taken along the line A—A in FIG. 4A after the device is assembled. On one surface of a dielectric member 5, conductive films 2*a* and 2*b* having a first slot 3*a* are formed. On another surface of the dielectric member 5, conductive films 2*c* and 2*d* having a second slot 3*b* which opposes the first slot 3*a* are formed. On the top of the conductive films 2*a* and 2*b*, resistive films 4*a* and 4*b* are formed along the first slot 3*a* at both sides of the slot 3*a*. In FIGS. 4A and 4B, a magnetic member 1 has ferrimagnetic characteristics and includes a ferrite or a YIG. The magnetic member 1 and the dielectric member 5 are stacked to form a substrate. An external DC magnetic field Ho is applied to the substrate so as to be parallel to the substrate and to be perpendicular to the slots. Thus, the nonreciprocal circuit device to be employed as an isolator is obtained.

As described above, the nonreciprocal circuit device includes a planar dielectric transmission line formed on the dielectric member, the resistive films formed along the slot portion on one surface, and the magnetic member stacked thereon. In this arrangement, when the signal propagates in the blocking direction, the electromagnetic field distribution of a propagation mode is localized on the side of the magnetic member, thus electrical power is consumed in the resistive films. When the signal propagates in the transfer direction, most of the electromagnetic field distribution is contained in the dielectric member. Therefore, the signal is transmitted with low insertion loss.

Referring now to FIGS. 5A to 5C, a structure of a nonreciprocal circuit device according to a third embodiment of the present invention is described. FIG. 5A is an exploded perspective view of the nonreciprocal circuit device. FIG. 5B is a cross sectional view taken along the line A—A in FIG. 5A after the device is assembled. FIG. 5C is a perspective view of a magnetic member having a pattern different from that shown in FIG. 5A. As in the second embodiment, conductive films 2*a* and 2*b* having a first slot 3*a* are formed on one surface of a dielectric member 5, and conductive films 2*c* and 2*d* having a second slot 3*b* which opposes the first slot 3*a* are formed on another surface of the dielectric member 5. In this embodiment no resistive film is formed on the dielectric member 5.

In FIGS. 5A to 5C, a magnetic member 1 having ferrimagnetic characteristics is made of a ferrite or a YIG. On the top of the magnetic member 1, a resistive film 4 is disposed at a location opposite to the first slot 3*a*. The magnetic member 1 and the dielectric member 5 are stacked to form a substrate. An external DC magnetic field Ho is applied to the substrate so as to be parallel to the substrate and to be perpendicular to the slots. Thus, the nonreciprocal circuit device for being employed as an isolator is constituted.

As described above, the nonreciprocal circuit device includes a planar dielectric line formed on the dielectric member and the magnetic member stacked thereon, in which the slot on one surface and the resistive film oppose each other with the magnetic member therebetween. In this arrangement, when the signal propagates in the blocking direction, the electromagnetic field distribution of the propagation mode is localized on the side of the magnetic member, thus electrical power is consumed in the resistive film. When the signal propagates in the transfer direction, almost all the electromagnetic field distribution is contained in the dielectric member. Therefore, the signal is transmitted with low insertion loss.

When the signal is incident in the blocking direction, the characteristic impedance is varied due to the resistive film 4. As illustrated in either FIG. 5A or FIG. 5C, ends of the resistive film 4 are tapered in the propagating direction of the signal. When the signal propagates in the blocking direction, the characteristic impedance of the transmission line changes gradually, and signal reflection is thereby suppressed. When the signal propagates in the transfer direction, there is no significant influence by the resistive film because the electromagnetic field energy density on the side of the resistive film is low.

Referring now to FIGS. 6A–6C, FIGS. 7A and 7B, and FIGS. 8A to 8C, a structure of a nonreciprocal circuit device according to a fourth embodiment of the present invention is described.

Figure 6A:
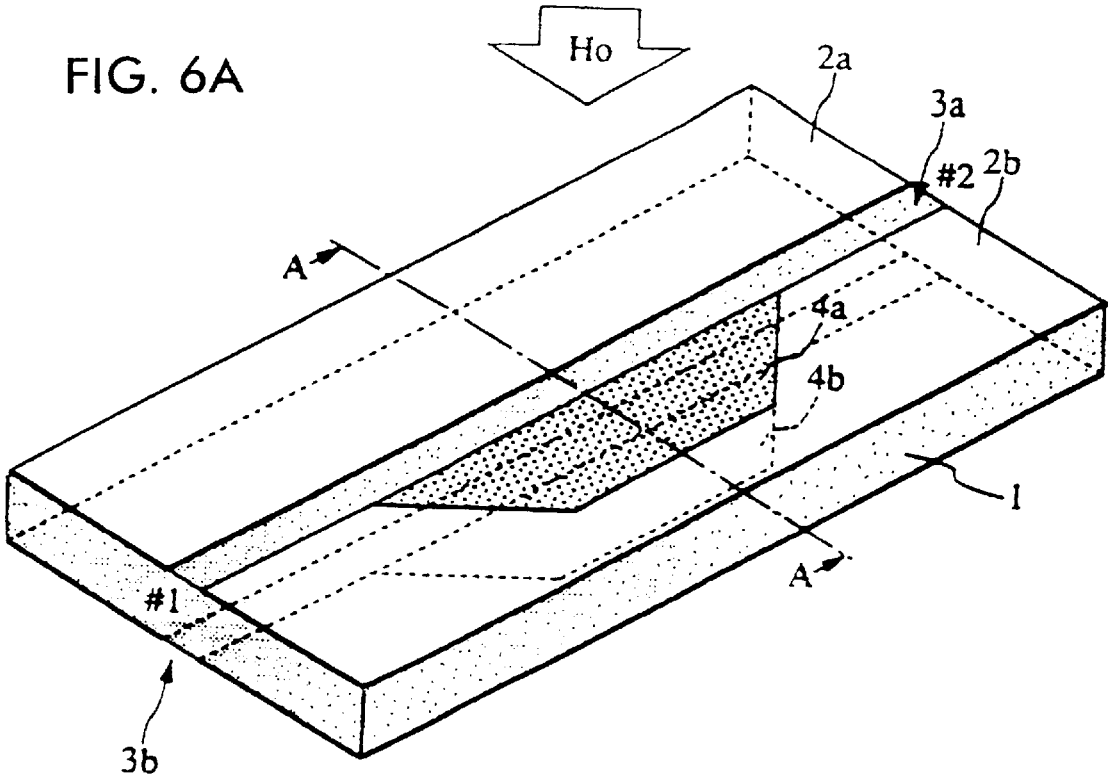
FIG. 6A is a perspective view of a nonreciprocal circuit device according to a fourth embodiment of the present invention.
Figure 6B:
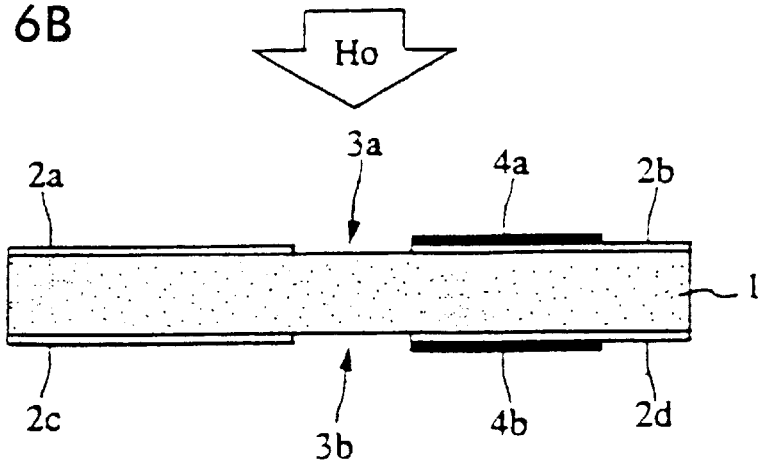
FIG. 6B is a cross sectional view of the nonreciprocal circuit device taken along the line A—A in FIG. 6A.

FIG. 6A is a perspective view of the nonreciprocal circuit device. FIG. 6B is a cross sectional view taken along the line A—A in FIG. 6A. In FIGS. 6A and 6B, a magnetic member 1 having ferrimagnetic characteristics is made of a ferrite or a YIG. On one surface of the magnetic member 1, conductive films 2*a* and 2*b* defining a first slot 3*a* are formed. On another surface of the magnetic member 1, conductive films 2*c* and 2*d* defining a second slot 3*b* which is opposed to the first slot 3*a* are formed. On the surface of the conductive film 2*b*, a resistive film 4*a* is formed along the first slot 3*a*. On the surface of the conductive film 2*d*, a resistive film 4*b* is formed along the second slot 3*b*. An external DC magnetic field Ho is applied to the magnetic member 1 in the perpendicular direction.

Figure 7A:
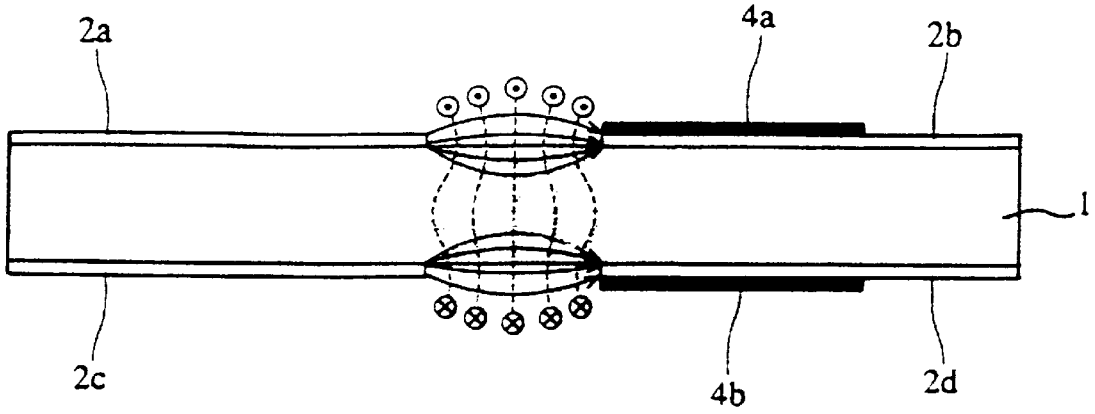
FIGS. 7A and 7B are cross sectional views taken along the lines A—A in FIGS. 6A and 6B to schematically illustrate the magnetic field distribution of the nonreciprocal circuit device shown in FIGS. 6A and 6B.
Figure 7B:
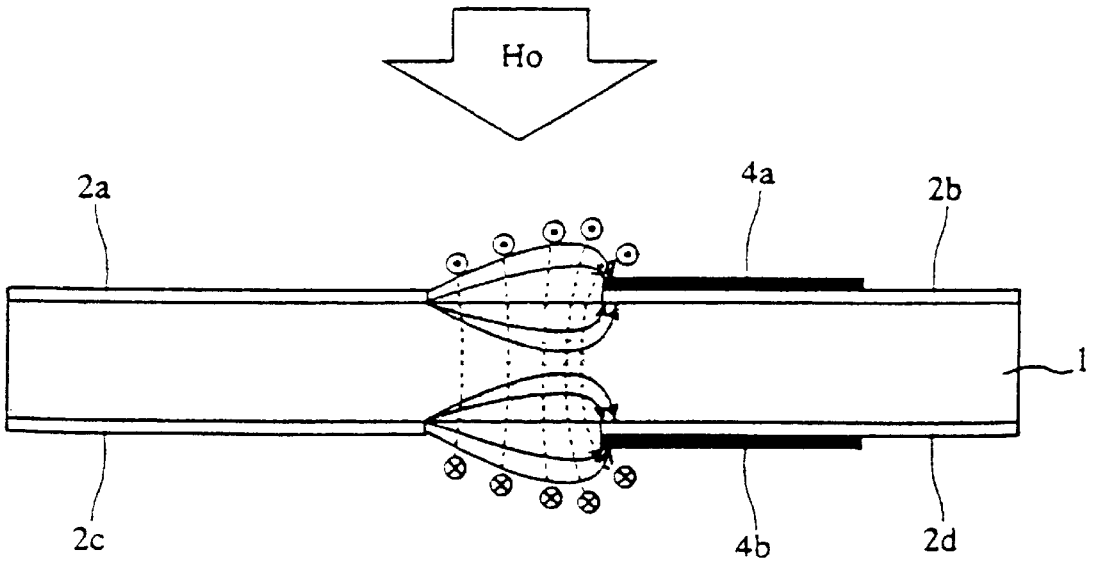

FIGS. 7A and 7B are sectional views taken along the line A—A in FIG. 6A to illustrate changes in the electromagnetic field distribution of the PDTL mode caused by the application of the external DC magnetic field. In this embodiment, a signal propagates from the back to the front (from port #2 to port #1 in FIG. 6A). In FIGS. 7A and 7B, solid lines represent electric field distributions, and broken lines represent magnetic field distributions. When the DC magnetic field Ho is not applied, the signal propagates in the normal PDTL mode, as shown in FIG. 7A. When the DC magnetic field Ho is applied, as shown in FIG. 7B, the electromagnetic field distribution of the PDTL mode is drawn to the right, and energy of the electromagnetic field is concentrated in the conductive films disposed on the right side of the first and second slots where the resistive films are formed. Therefore, electrical power is consumed when current flows in the resistive films 4*a* and 4*b*, so that the signal in the PDTL mode is greatly attenuated. In contrast, when the signal propagates from the front to the back (from port #1 to port #2), the electromagnetic field distribution of the PDTL mode is drawn to the left, and the electromagnetic field energy distribution becomes sparse on the side of the resistive films 4*a* and 4*b*. As a result, power consumption by the resistive films 4*a* and 4*b* is suppressed, and the signal propagates without being significantly attenuated. With this operation, the device may be used as an isolator which selectively propagates signals in the direction from port #1 to port #2. When the DC magnetic field is in the reverse direction, the localizing direction of the electromagnetic field of the propagation mode, which is determined in accordance with the direction of the DC magnetic field and the propagating direction of the signal, is reversed. Thus, the isolation is reversed in direction.

Figure 6C:
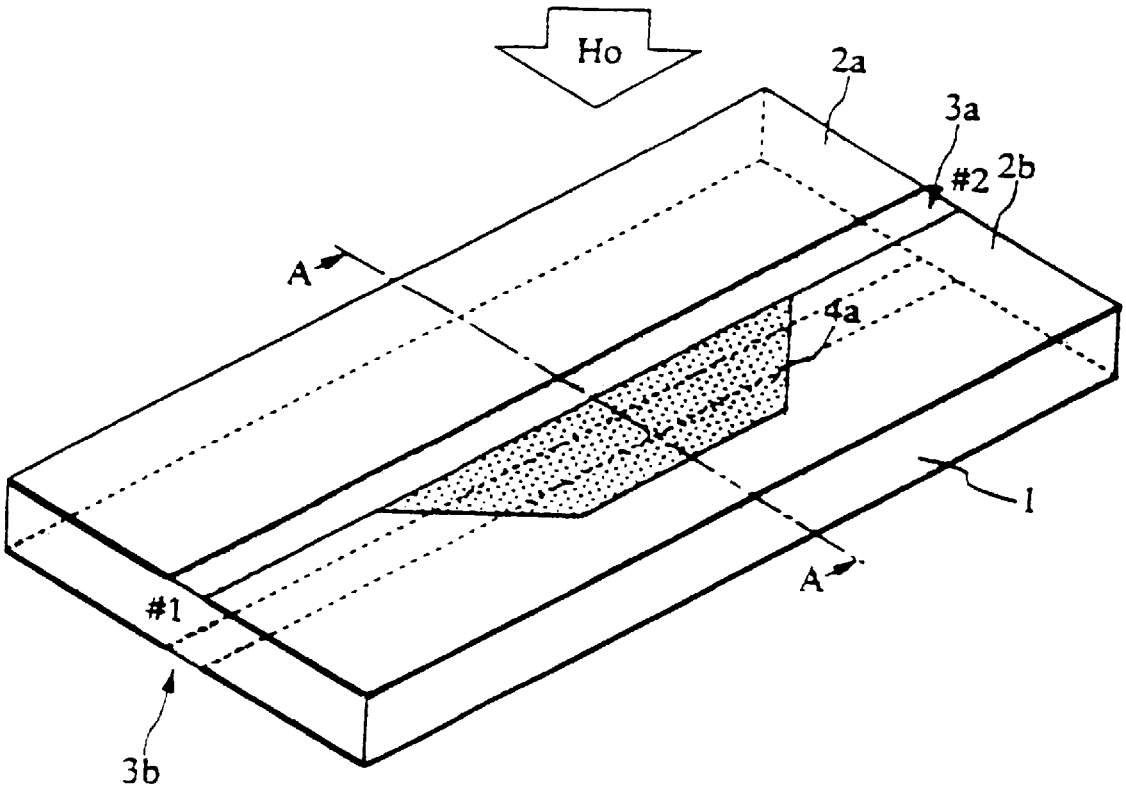
FIG. 6C is a perspective view showing a modification of the embodiment shown in FIG. 6A.

FIG. 6C shows a modification of the embodiment of FIG. 6A. One of the resistive films, for example the resistive film 4b, can be eliminated if desired, while still obtaining the advantages described above.

As shown in FIGS. 6A–6C, ends of the resistive films 4*a* and 4*b* along the slots are tapered. When the signal propagates in the blocking direction, characteristic impedance of the transmission line changes gradually, and signal reflection is thereby suppressed. When the signal propagates in the transfer direction, there is no significant influence by the resistive films because the electromagnetic field energy density on the side of the resistive films is low. As shown in FIG. 6A, when the width of the resistive films gradually increases, the characteristic impedance of the transmission line changes gradually even when the signal propagates in the transfer direction. Thus, significant signal reflection will not be caused by the resistive films.

Figure 8A:
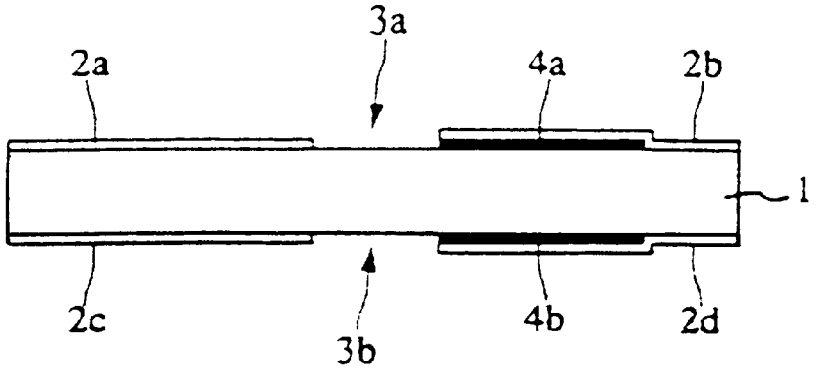
FIGS. 8A to 8C are cross sectional views of other examples of the nonreciprocal circuit device shown in FIGS. 6A and 6B.
Figure 8B:
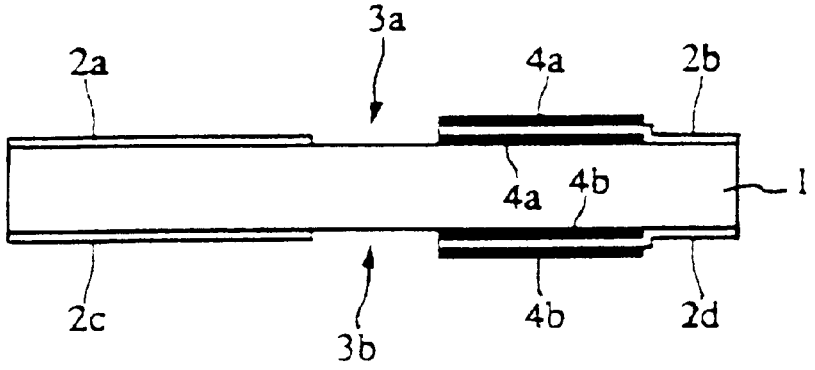
Figure 8C:
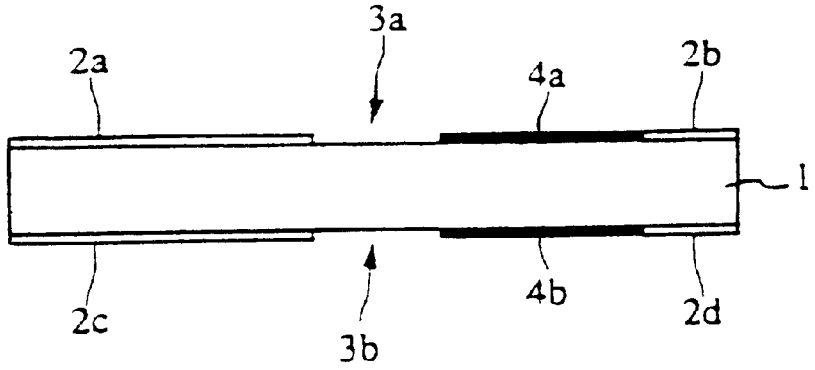

FIGS. 8A to 8C are cross sectional views of other embodiments of the nonreciprocal circuit device shown in FIGS. 6A and 6B. The cross sectional views are orthogonal to the slots. The resistive films of these embodiments have the same plane pattern as that shown in FIG. 6A. In the embodiment shown in FIG. 8A, the resistive films 4*a* and 4*b* are formed on the surface of the magnetic member 1, and the conductive films 2*b* and 2*d* are formed on the resistive films. In the embodiment shown in FIG. 8B, the resistive films 4*a* and 4*b*, the conductive films 2*b* and 2*d*, and additional resistive films 4*a* and 4*b* are stacked in that order. As in these two embodiments, illustrated in FIGS. 8A and 8B, even when the conductive films and the resistive films are stacked together, current distribution is concentrated in the resistive films due to the skin effect. Thus, electrical power is efficiently consumed.

In the embodiment shown in FIG. 8C, the resistive films 4*a* and 4*b* are formed in the same plane as the conductive films 2*b* and 2*d*.

Alternatively, only one of the resistive films 4*a* and 4*b* may be formed. In such a case, when the signal propagates in the blocking direction, electrical power is consumed in the resistive film portion. Thus, the signal propagation is blocked.

Figure 9A:
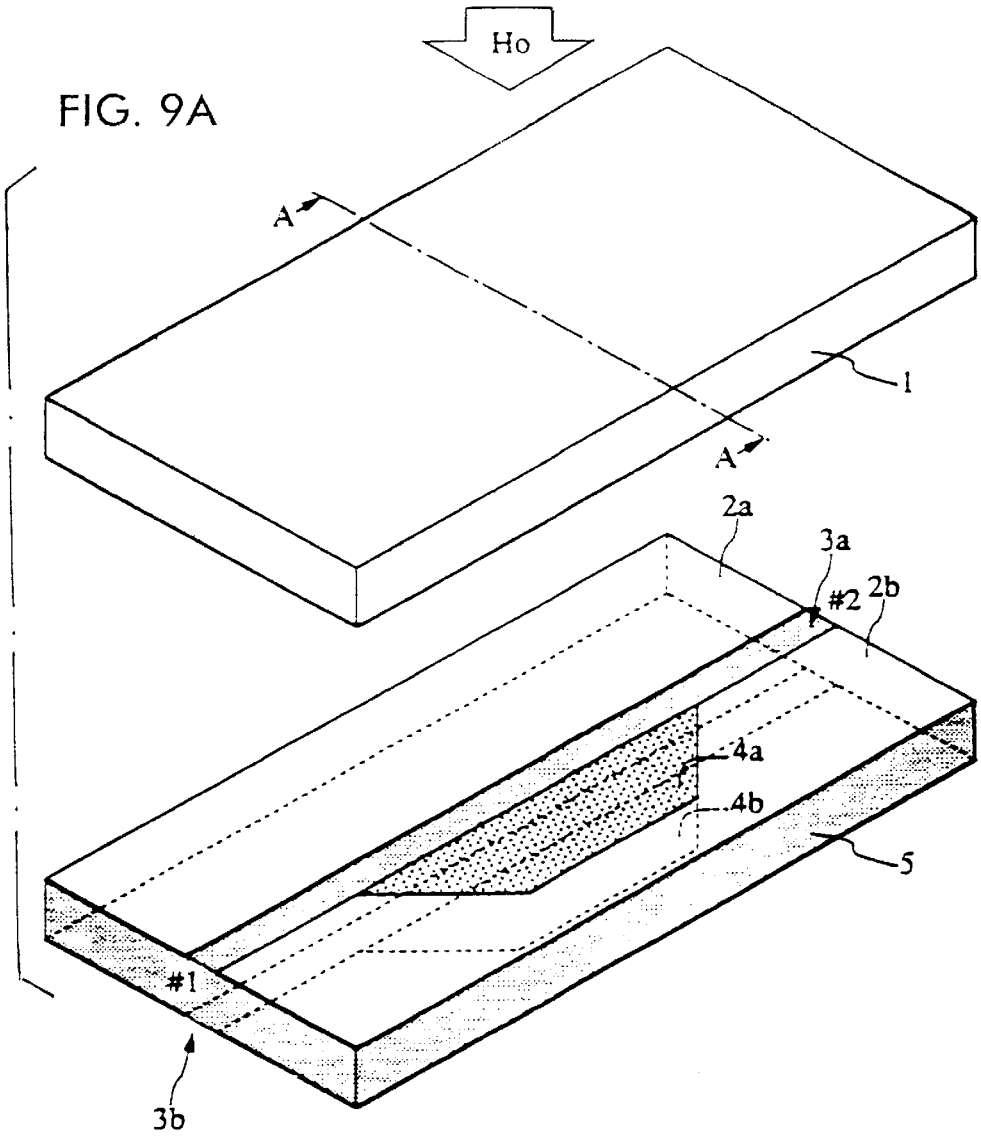
FIG. 9A is an exploded perspective view of a nonreciprocal circuit device according to a fifth embodiment of the present invention.
Figure 9B:
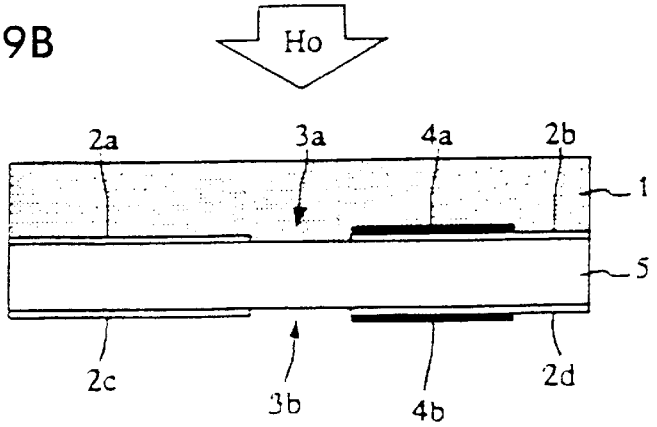
FIG. 9B is a cross sectional view of the nonreciprocal circuit device taken along the line A—A in FIG. 9A.

Referring now to FIGS. 9A and 9B, a structure of a nonreciprocal circuit device according to a fifth embodiment of the present invention is described. FIG. 9A is an exploded perspective view of the nonreciprocal circuit device. FIG. 9B is a cross sectional view of the nonreciprocal circuit device along the line A—A in FIG. 9A after the device is assembled. In FIGS. 9A and 9B, conductive films 2*a* and 2*b* which define a first slot 3*a* are formed on one surface of a dielectric member 5. On another surface of the dielectric member 5, conductive films 2*c* and 2*d* which define a second slot 3*b* which is opposed to the first slot 3*a* are formed. On the surface of the conductive film 2*b* which is a side of the conductive films 2*a* and 2*b*, a resistive film 4*a* is formed along the first slot 3*a*. On the surface of the conductive film 2*d* which is a side of the conductive films 2*c* and 2*d*, a resistive film 4*b* is formed along the second slot 3*b*. A magnetic member 1 having ferrimagnetic characteristics is made of a ferrite or a YIG. The magnetic member 1 and the dielectric member 5 are stacked to form a substrate. An external DC magnetic field Ho is applied to the substrate in the perpendicular direction, and the nonreciprocal circuit device that can be employed as an isolator is thereby obtained.

As described above, the nonreciprocal circuit device includes a planar dielectric line formed on the dielectric member, the resistive films formed along the slots, and the magnetic member stacked thereon. In this arrangement, when the signal propagates in the blocking direction, the electromagnetic field distribution of the propagation mode is localized in the direction of the resistive films, thus electrical power is consumed in the resistive films. When the signal propagates in the transfer direction, the electromagnetic field distribution is sparse in the direction of the resistive films, so that almost no electrical power is consumed by the resistive films. Therefore, the signal is transmitted with low insertion loss.

Figure 10:
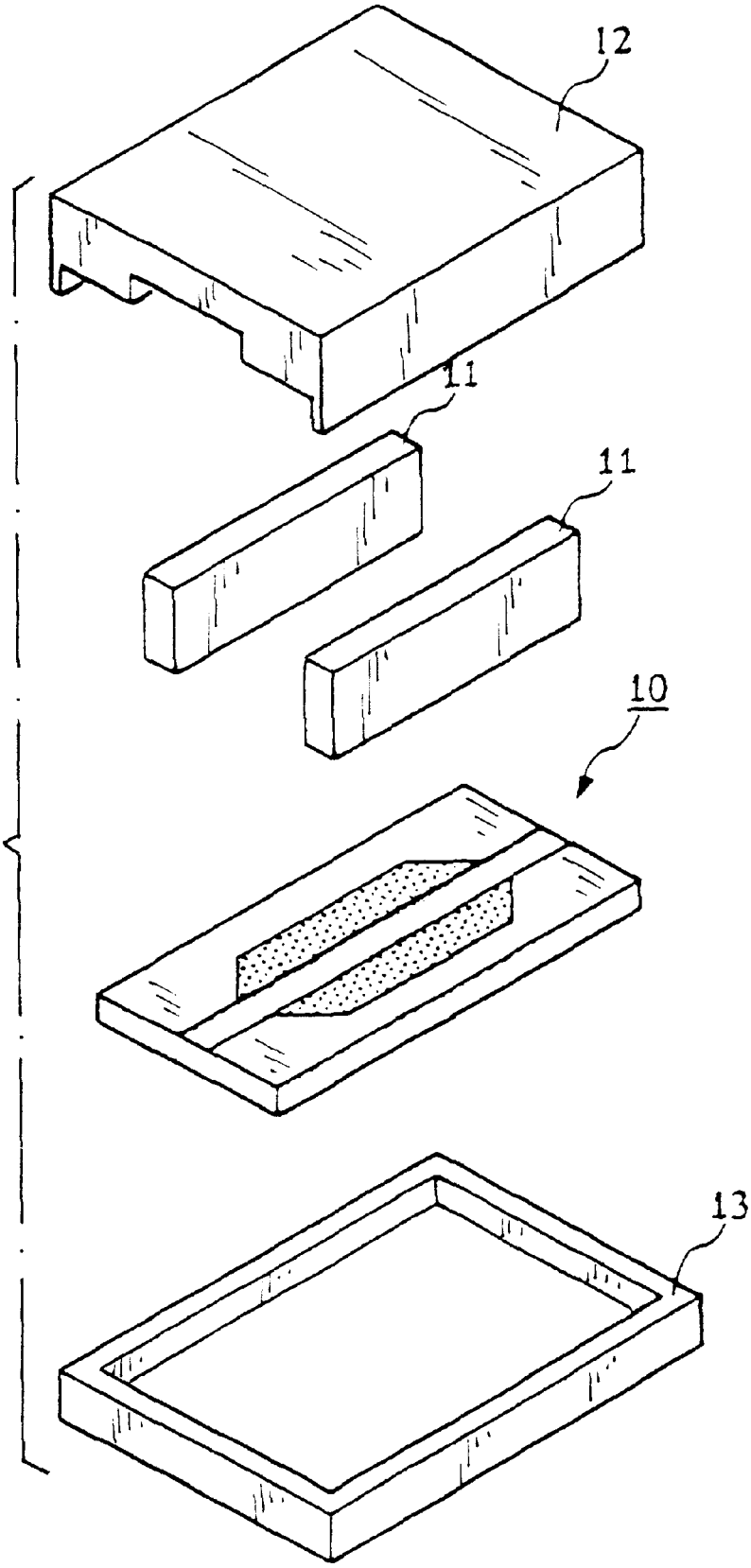
FIG. 10 is an exploded perspective view of an isolator according to a sixth embodiment of the present invention.
Figure 11A:
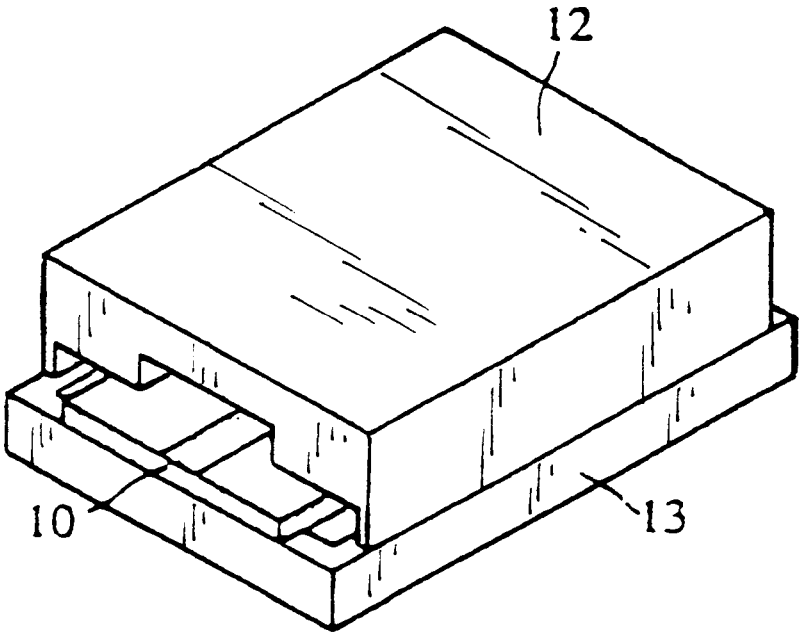
FIG. 11A is a perspective view of the isolator shown in FIG. 10.
Figure 11B:
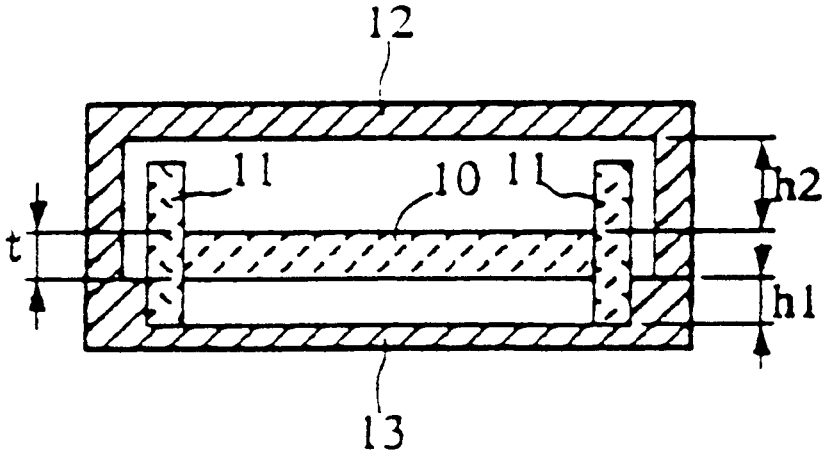
FIG. 11B is a cross sectional view of the isolator shown in FIG. 10.

In the embodiments described above, only the basic component parts forming the nonreciprocal circuit device have been illustrated. Referring now to FIG. 10 and FIGS. 11A and 11B, an embodiment of a nonreciprocal circuit apparatus, namely an isolator according to a sixth embodiment of the present invention, is described.

FIG. 10 is an exploded view of the overall isolator. A substrate 10 includes, for example, the substrate of the nonreciprocal circuit device shown in FIG. 1A. Any of the other embodiments shown in FIGS. 1B–5C can be used as well. Magnets 11 apply a DC magnetic field parallel to the substrate 10 and perpendicular to the slots. A carrier 13 holds the substrate 10 and the magnets 11. The carrier 13 is also used as a yoke for the magnets 11, and it is therefore made of a magnetic material. A cap 12 covers the top.

FIG. 11A is a perspective view of the isolator shown in FIG. 10. FIG. 11B is a sectional view of the isolator. Referring to FIGS. 11A and 11B, the cap 12 is smaller than the carrier 13, so that the two input/output ports of the substrate 10 are exposed. Referring to FIG. 11B, magnetic poles of the two magnets 11 are disposed on both sides, and the carrier 13 is used as the yoke. Specifically, the carrier 13 and the substrate 10 form a magnetic path for the magnets 11, which apply the DC magnetic field to the substrate 10 in the parallel direction.

Both the distance h1 between the conductive films on the substrate 10 and the inner surface of the carrier 13 and the distance h2 between the conductive films on the substrate 10 and the inner surface of the cap 12 are set to be no more than half of the wavelength λg in the waveguide. Therefore, no unnecessary electromagnetic field in a parallel plate mode will be excited in the space between the substrate 10 and the carrier 13 and in the space between the substrate 10 and the cap 12. The thickness t between the conductive films on the substrate 10 is set to be no more than half of the wavelength in the substrate 10. Therefore, no unnecessary electromagnetic field in the parallel plate mode will not be excited in the substrate 10. A relative dielectric constant er of a magnetic member or a dielectric member between the parallel conductive films is set to be 15, for example. When the isolator is used in the 20 GHz band, the thickness t is set to be 1 mm or less.

Figure 12:
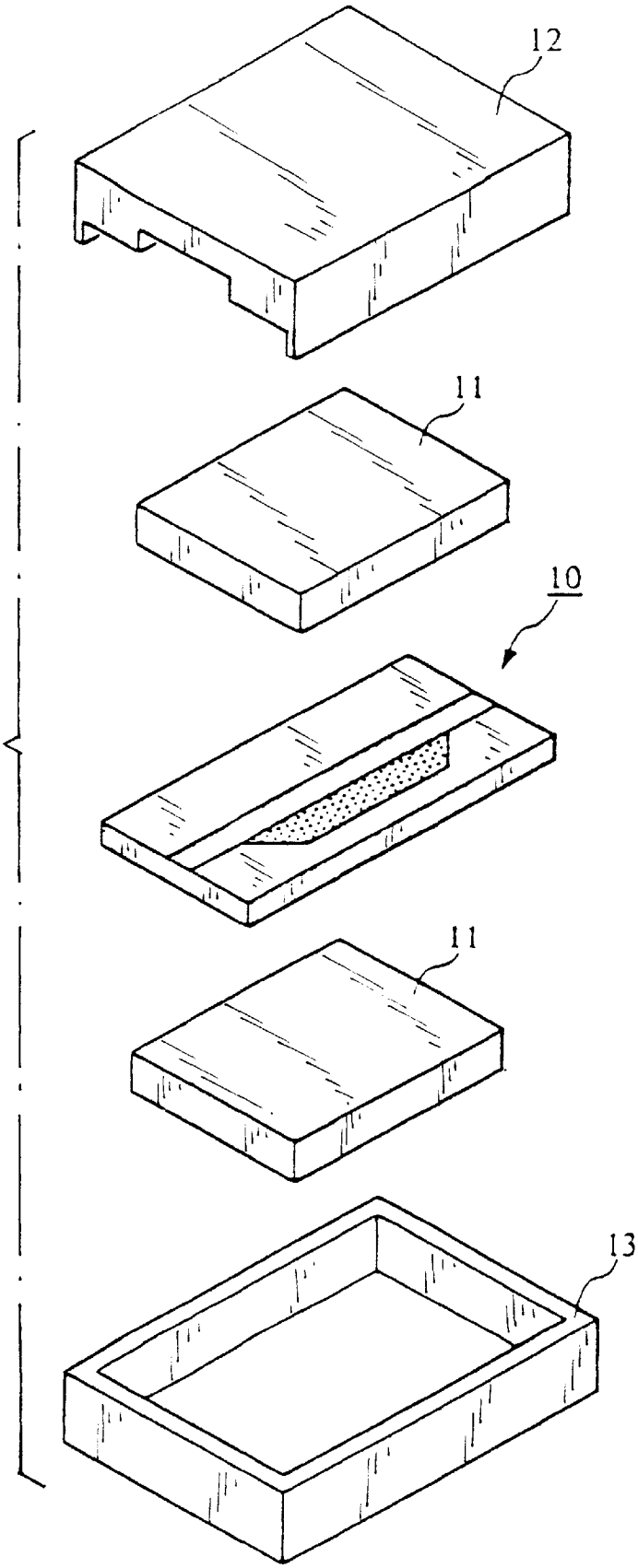
FIG. 12 is an exploded perspective view of an isolator according to a seventh embodiment of the present invention.
Figure 13A:
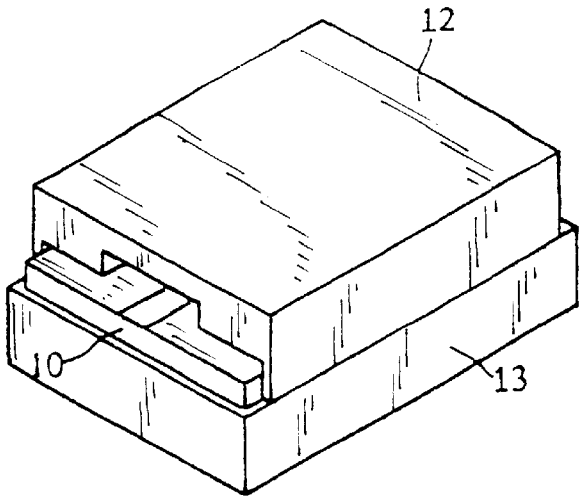
FIG. 13A is a perspective view of the isolator shown in FIG. 12.
Figure 13B:
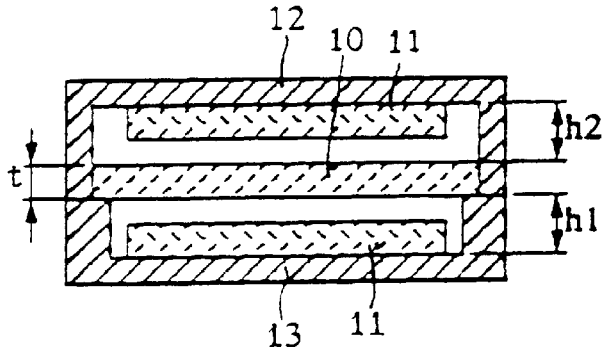
FIG. 13B is a cross sectional view of the isolator shown in FIG. 12.

Referring to FIG. 12 and FIGS. 13A and 13B, a structure of an isolator according to a seventh embodiment of the present invention is described. This isolator operates by applying a DC magnetic field to a substrate in the perpendicular direction.

FIG. 12 is an exploded perspective view of the overall isolator. A substrate 10 includes a substrate of a nonreciprocal circuit device, such as the substrate shown in FIGS. 6A and 6B. The embodiments shown in FIGS. 8A–9B can be used as well. Magnets 11 apply a DC magnetic field to the substrate 10 in the perpendicular direction. A carrier 13 holds the substrate 10 and the lower magnet 11 in place. A cap 12 holds the upper magnet 11 in place and covers the carrier 13. The carrier 13 and the cap 12 are employed as a yoke for the magnets 11, and they are therefore made of magnetic materials.

FIG. 13A is a perspective view of the above isolator. FIG. 13B is a sectional view of the above isolator. Referring to FIG. 13B, magnetic poles of the two magnets 11 are disposed on both sides, and the carrier 13 and the cap 12 operate as the yoke for the magnets 11. Specifically, the carrier 13, the cap 12, and the substrate 10 form a magnetic path for the magnets 11, which apply the magnetic field to the substrate 10 in the perpendicular direction.

Both the distance h1 between the conductive films on the substrate 10 and the inner surface of the carrier 13 and the distance h2 between the conductive films on the substrate 10 and the inner surface of the cap 12 are set to be not more than half of the wavelength λg in the waveguide. The thickness t between the conductive films on the substrate 10 is set to be not more than half of the wavelength in the substrate 10. Therefore, no unnecessary parallel plate mode will be excited between the top of the substrate 10 and the carrier 13, between the bottom of the substrate 10 and the cap 12, and between the top and bottom conductive films on the substrate 10.

Figure 14:
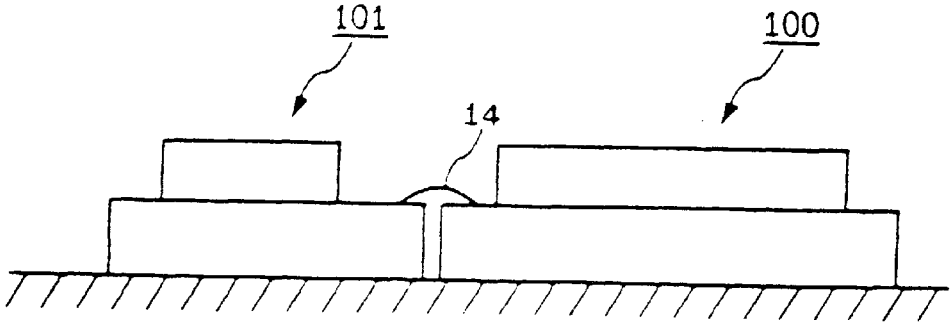
FIG. 14 illustrates a connecting structure of a device having nonreciprocal circuit characteristics and another circuit device.

When a high frequency circuit is formed using a device having nonreciprocal circuit characteristics, such as the isolator described above, the conductive film portions on the substrate having the nonreciprocal circuit characteristics are used as an electrodes, which may be electrically connected to an electrode of another circuit device. For example, as shown in FIG. 14, an isolator 100 and another circuit device 101 are mounted on a common base member, and they are bonded by a wire 14.

Figure 15:
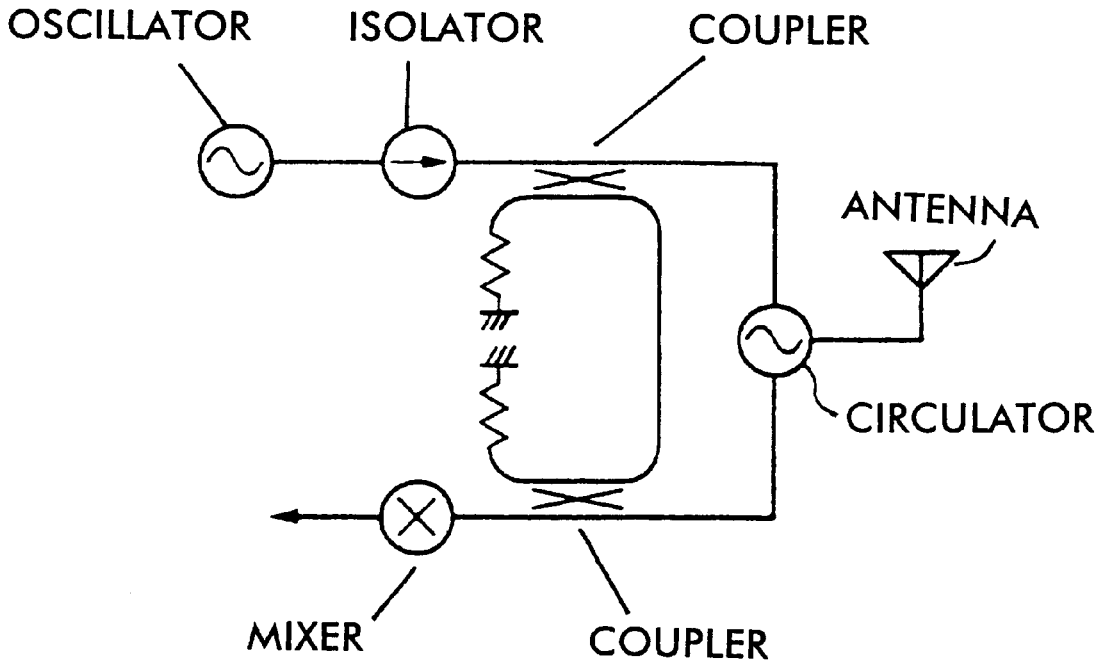
FIG. 15 is a block diagram of a millimeter-wave radar module.

Referring to FIG. 15, a millimeter-wave radar module as an embodiment of a transceiver formed with the above isolator is described.

FIG. 15 is a block diagram of the overall transceiver. With continued reference to FIG. 15, an oscillator generates a transmitter signal. The isolator propagates the signal in one direction so that the signal will not propagate in the reverse direction and return to the oscillator. A circulator directs the transmitter signal to an antenna and propagates a receiver signal from the antenna to a mixer. The antenna transmits the transmitter signal as electromagnetic radiation, and receives a wave reflected from an object. One of two couplers extract a local signal by coupling with an output signal of the isolator. Another coupler mixes the local signal and the receiver signal, and sends the resultant signal to the mixer. The mixer, as a nonlinear device, generates a harmonic wave having a frequency component which is the difference between the local signal and the receiver signal.

A controller using the above millimeter-wave radar module periodically modulates an oscillation signal of the oscillator and measures the distance to the object and the relative velocity based on the frequency of the difference between the local signal and the receiver signal and changes thereof over time.

A transmission line of the above millimeter-wave radar module includes a line of a PDTL mode formed on a dielectric member. Each circuit device is integrally mounted on the dielectric member. For example, a ferrite substrate is stacked on the dielectric member at a predetermined location, and thereby an isolator is constituted as shown in FIGS. 4A and 4B or in FIGS. 5A to 5C.

Although the present invention has been described in relation to particular embodiments thereof, many other variations and modifications and other uses will become apparent to those skilled in the art. Therefore, the present invention is not limited by the specific disclosure herein.

What is claimed is:

1. A nonreciprocal circuit device comprising:

conductive films formed on both sides of a substrate having ferrimagnetic characteristics, first and second slots formed respectively in the conductive films and opposing each other; and at least one resistive film formed near at least a portion of the slot on one of the sides of the substrate;

said nonreciprocal circuit device being adapted to receive a DC magnetic field applied to said substrate in a direction substantially parallel to said substrate and substantially perpendicular to the first and second slots.

2. A nonreciprocal circuit device comprising:

a substrate having ferrimagnetic characteristics, said substrate comprising a magnetic member having ferrimagnetic characteristics and a dielectric member stacked together;

conductive films formed on opposing sides of the dielectric member;

first and second slots formed respectively in the conductive films and opposing each other; and at least one resistive film formed near at least a portion of the slot on one of the sides of the dielectric member;

said nonreciprocal circuit device being adapted to receive a DC magnetic field applied to said substrate in a direction substantially parallel to said substrate and substantially perpendicular to the first and second slots.

3. A nonreciprocal circuit device comprising:

conductive films formed on both sides of a substrate having ferrimagnetic characteristics, first and second slots formed respectively in the conductive films and opposing each other; and a resistive film formed on the substrate near at least a portion of one side of at least one of the first and second slots;

said nonreciprocal circuit device being adapted to receive a DC magnetic field applied to said substrate in a direction substantially perpendicular to said substrate.

4. A nonreciprocal circuit device comprising:

a substrate having ferrimagnetic characteristics, said substrate comprising a magnetic member having ferrimagnetic characteristics and a dielectric member stacked together;

conductive films formed on opposing sides of the dielectric member;

first and second slots formed respectively in the conductive films and opposing each other; and a resistive film formed on the substrate near at least a portion of one side of at least one of the first and second slots;

said nonreciprocal circuit device being adapted to receive a DC magnetic field applied to said substrate in a direction substantially perpendicular to said substrate.

5. A nonreciprocal circuit device comprising:

conductive films formed on both sides of a dielectric member, first and second slots formed respectively in the conductive films and opposing each other;

a magnetic member having ferrimagnetic characteristics;

a resistive film opposing one of the areas of the first and second slots being formed on the magnetic member; and a substrate being formed by the magnetic member and the dielectric member stacked together;

said nonreciprocal circuit device being adapted to receive a DC magnetic field applied to the substrate formed by the dielectric member and the magnetic member in a direction substantially parallel to the dielectric member and the magnetic member and substantially perpendicular to the first and second slots.

6. A nonreciprocal circuit device according to one of claims 1 to 5, wherein an end of the resistive film along the direction of the slot is tapered.

7. A communications apparatus comprising:

one of a transmitter and a receiver; and connected thereto, a nonreciprocal circuit device as set forth in claim 6.

8. A nonreciprocal circuit apparatus comprising:

a nonreciprocal circuit device as set forth in one of claims 1 to 5;

a yoke forming a magnetic path for said DC magnetic field and covering a periphery of said substrate; and a magnet which generates the DC magnetic field.

9. A communications apparatus comprising:

one of a transmitter and a receiver; and connected thereto, a nonreciprocal circuit apparatus as set forth in claim 8.

10. A communications apparatus comprising:

one of a transmitter and a receiver; and connected thereto, a nonreciprocal circuit device as set forth in one of claims 1 to 5.

* * * * *